US007596981B2

(12) United States Patent
Di Serio

(10) Patent No.: US 7,596,981 B2
(45) Date of Patent: Oct. 6, 2009

(54) METHOD FOR MANUFACTURING MOLDED THEN FORGED PARTS COMPRISING ONE OR MORE RECESSES AND THE IMPLEMENTATION INSTALLATION THEREOF

(76) Inventor: Emile Di Serio, 630 Boulevard General Leclerc, 69400 Villefranche sur Saone (FR)

( * ) Notice: Subject to any disclaimer, the term of this patent is extended or adjusted under 35 U.S.C. 154(b) by 1124 days.

(21) Appl. No.: 10/035,018

(22) Filed: Dec. 27, 2001

(65) Prior Publication Data

US 2003/0000278 A1 Jan. 2, 2003

(30) Foreign Application Priority Data

Dec. 27, 2000 (FR) ..... 00 17337

(51) Int. Cl.
*B21J 13/00* (2006.01)
*B21D 31/00* (2006.01)

(52) U.S. Cl. ..... 72/355.4; 72/364

(58) Field of Classification Search ..... 72/352, 72/353.2, 354.6, 355.4, 364; 29/527.5
See application file for complete search history.

(56) References Cited

U.S. PATENT DOCUMENTS 362,113 A * 5/1887 Rigby ..... 29/894.01
4,569,218 A * 2/1986 Baker et al. ..... 72/342.1

FOREIGN PATENT DOCUMENTS

| | | |
|---|---|---|
| EP | 0 338 419 A1 | 4/1989 |
| EP | 0 955 113 A1 | 11/1999 |
| JP | 05146841 | 6/1993 |
| JP | 07195136 | 8/1995 |

* cited by examiner

*Primary Examiner*—Dana Ross
*Assistant Examiner*—Teresa Bonk
(74) *Attorney, Agent, or Firm*—Heslin Rothenberg Farley & Mesiti P.C.; Victor A. Cardona, Esq.

(57) ABSTRACT

This method is original in that it implements the following phases: a foundry preform is created that includes one or more pierced or blind recesses or cavities that match the useful or required shapes of the end part to be obtained; the preform is transferred to a tunnel furnace that ensures a uniform temperature of said preform; the foundry preform is positioned in a heading die disposed on a press; one or more multidirectional rods are introduced into the recess(es) or cavity(ies) of the foundry preform, according to a command prior to the forging operation; sizing operation of the preform that receives the rod(s) in the phase during which the rod(s) are temporarily positioned inside the shaped recess(es), the upper forging die is raised to free the forged preform; the rod (s) positioned in the recess (es) are withdrawn; and the forged preform is removed.

2 Claims, 2 Drawing Sheets

METHOD FOR MANUFACTURING MOLDED THEN FORGED PARTS COMPRISING ONE OR MORE RECESSES AND THE IMPLEMENTATION INSTALLATION THEREOF

CROSS REFERENCE TO RELATED APPLICATIONS

This application claims priority of French application 00.17337, filed Dec. 27, 2000, the entire disclosure of which is incorporated herein by reference.

The invention relates to the technical sector of the manufacture of light alloy parts, such as aluminium alloy parts, that are cast in foundries and then forged. Many parts are foundry-produced then forged according to the COBAPRESS method, which is the subject of European patent No. 119,365, for light alloys and particularly aluminium. These parts often require additional machining operations to create bores, recesses or blind holes that relate directly to the use and applications of the part itself on products of varying degrees of complexity. In this event it is then necessary, after the foundry and forgery operation, to transfer the parts in question to other workstations to perform the necessary shaping operations, such as machining the recesses and cavities present on the end product.

These operations increase the production chain and resulting cost considerably.

The applicant has therefore attempted to overcome these drawbacks and difficulties while maintaining and guaranteeing the production quality of the end product obtained.

The use of rods is also known in foundry moulds, the role of said rods being to produce foundry parts with recesses.

The applicant, bearing in mind all the above information, has therefore developed a new method for manufacturing parts that are moulded then forged according to the invention that preserves the recesses of the cast preform and that eliminates all or some of the subsequent tooling operations mentioned above which were previously necessary.

According to the invention, the method is original in that it implements the following phases:

- creating a foundry preform including one or more pierced or blind recesses or cavities that match the useful or required shapes of the end part to be obtained;
- transferring the preform to a tunnel furnace that ensures a uniform temperature of said preform;
- positioning the foundry preform in a heading die disposed on the press;
- introducing one or more multidirectional rods into the recess(es) or cavity(ies) of the foundry preform, according to a command prior to the forging operation;
- heading operation of the preform that receives the rod(s) in the phase during which the rod(s) are temporarily positioned inside the shaped recess(es).
- raising the upper forging die to free the forged preform;
- removing the rod(s) positioned in the recess(es);
- removing the forged preform.

As will be known by those skilled in the art, a heading operation refers to a cold working process wherein the material is squeezed into a die and finished parts assume the shape of a die, as defined in "eFunda" published at www.efunda.com (2001).

These characteristics and others relative to the method described above and to the technical means required in order to implement said method are described below.

A detailed description of the invention now follows with reference to the attached figures in which.

A non-limitative example will now be described in reference to the figures in order to provide a clearer understanding of the invention.

The method of the invention for manufacturing parts that are moulded then forged applies to any parts of any shape capable of having one or more pierced or blind recesses or cavities in the end shaped condition that are useful, functional or simply intended to lighten said parts. The part(s) are made of a light alloy, such as aluminium alloy.

Figure 1:
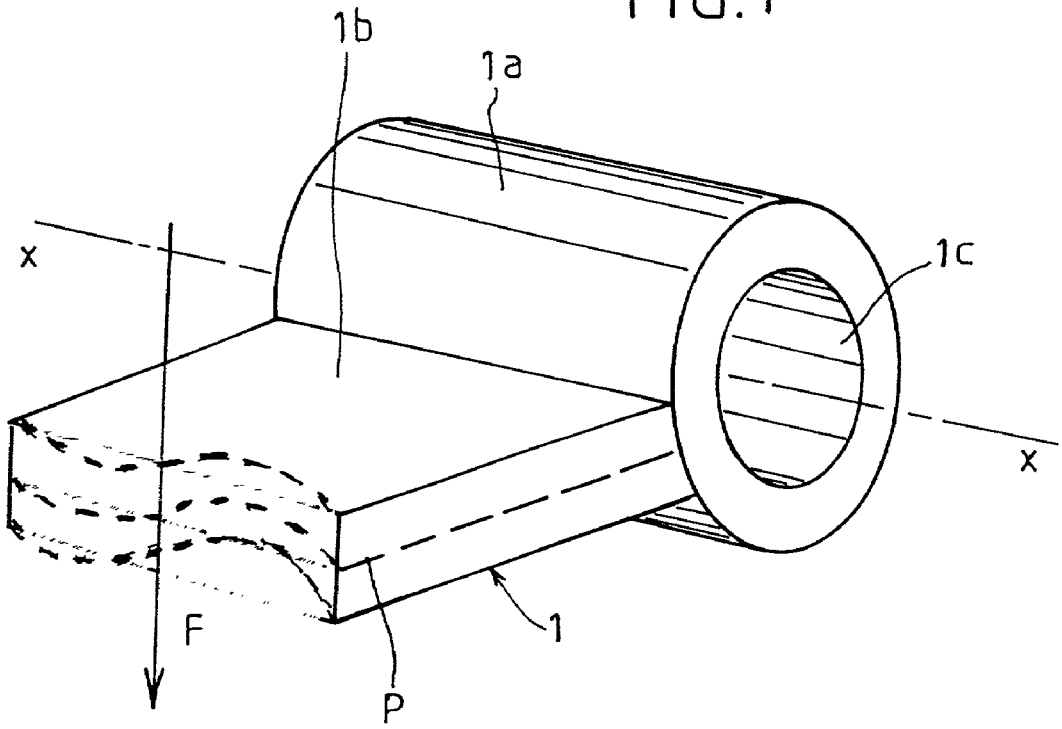
FIG. 1 is a view of any part presented in the preform condition according to the invention and intended to be forged.
Figure 2:
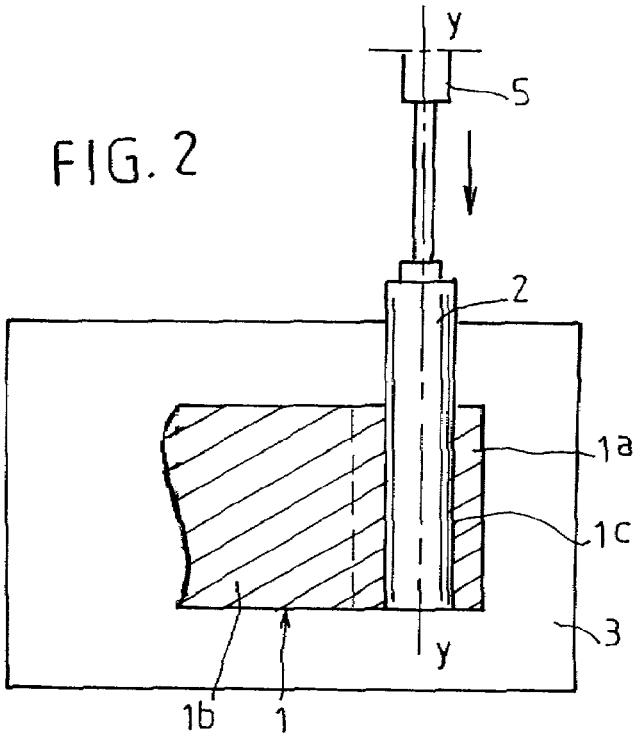
FIGS. 2 and 3 are schematic top views of the phases in which the rods are positioned in and removed from the preform during and after the forging operation.
Figure 3:
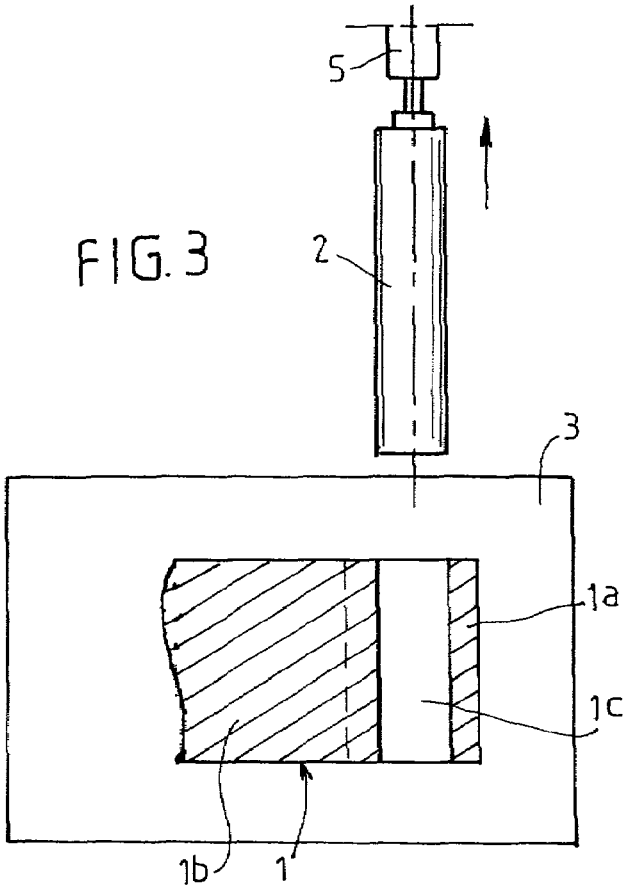

FIG. 1 is a foundry-cast preformed part 1 with a sleeve section 1*a* and a foot 1*b*, this configuration being simply an example to enable the invention to be better understood. The inside of said sleeve 1*a* has a recess 1*c* along all or part of its length. The figure shows parting line P and longitudinal axis X-X of the recess, and the direction of the sizing is shown by arrow F.

This part is intended to be obtained according to the COBAPRESS method described in European patent No. 119 365 that implements successive foundry-casting then forging operations for light alloy parts, such as aluminium alloy parts. An intermediary operation is included between the casting and forging operations in which the part in the foundry preformed condition is introduced into a tunnel furnace that heats and ensures a uniform temperature of said part before it is transferred to the forging station. Said foundry preform therefore has one or more recesses or cavities.

According to the invention, the forging tool is fitted around the heading die with one or more rod 2 translation mechanisms intended to be positioned temporarily in the foundry preform through the matching recess(es) 1*c* during the forging operation of said preform. More precisely, the foundry preform is positioned in the lower heading die 3, the upper die being raised. The positioning of the foundry preform in the lower forging die is such that said recess(es) face longitudinal axis Y-Y along which the rod(s) move, the two axes X-X and Y-Y coinciding.

The rod(s) are drawn to move by cylinder—or similar type control means 5. Production automation means are used to control the rod movement directly relative to the complete part-production method.

The method is operated and implemented as follows:

- a foundry preform is created that includes one or more pierced or blind recesses or cavities that match the useful or required shapes of the end part to be obtained;
- the preform is transferred to a tunnel furnace that ensures a uniform temperature of said preform;
- the foundry preform is positioned in a heading die disposed on a press;
- one or more multidirectional rods are introduced into the recess(es) or cavity(ies) of the foundry preform, according to a command prior to the forging operation, said rods being temporarily translated to be positioned in the foundry preform;
- heading operation of the preform that receives the rod(s) in the phase during which the rod(s) are temporarily positioned inside the shaped recess(es).
- the upper forging die is raised to free the forged preform;
- the rod(s) positioned in the recess(es) are withdrawn;
- the forged preform is removed.

The profile of the rod(s) is determined such that it matches that of the recess in the end part as closely as possible.

The advantages are as follows:

the shaping of the recess(es) being integrated in the forging operation, therefore resulting in reduced machining operations and production costs;

less material wasted on the recess(es) in the preform resulting in reduced weight and production costs, particularly for the machining operation;

recesses or pre-pierced holes that are multidirectional and not only in the direction of the heading.

The invention claimed is:

1. Method for manufacturing parts that are molded then forged comprising one or more recesses, characterized in that it implements the following phases:

a foundry preform is created that includes one or more pierced or blind recesses or cavities having one or more shapes that match the useful or required shapes of an end part to be obtained;

the preform is transferred to a tunnel furnace that ensures a uniform temperature of said preform;

the foundry preform is positioned in a heading die disposed on a press;

at least one multidirectional rod is introduced into at least one of a recess and a cavity of the one or more recesses or cavities of the foundry preform by a control means, according to a command prior to a heading operation;

the heading operation is performed on the preform that receives the at least one rod to create a forged preform, when the at least one rod is temporarily positioned inside the at least one of a recess and a cavity;

substantially maintaining by the at least one rod at least one shape of the one or more shapes of the at least one of a recess and a cavity during the heading operation;

an upper forging die is raised to free the forged preform;

the at least one rod positioned in the at least one of a recess and a cavity is withdrawn by the control means; and the forged preform is removed.

2. The method of claim 1 wherein the preform comprises a solid prior to the heading operation.

* * * * *